US006849036B2

(12) United States Patent
Forslid

(10) Patent No.: US 6,849,036 B2
(45) Date of Patent: Feb. 1, 2005

(54) GRIPPING DEVICE

(76) Inventor: Filip Forslid, Erik Dahlbergsgatan 23, Stockholm (SE), S-115 32

( * ) Notice: Subject to any disclaimer, the term of this patent is extended or adjusted under 35 U.S.C. 154(b) by 0 days.

(21) Appl. No.: 10/475,522

(22) PCT Filed: Apr. 24, 2002

(86) PCT No.: PCT/SE02/00799

§ 371 (c)(1),
(2), (4) Date: Oct. 28, 2003

(87) PCT Pub. No.: WO02/087708

PCT Pub. Date: Nov. 7, 2002

(65) Prior Publication Data

US 2004/0119305 A1 Jun. 24, 2004

(30) Foreign Application Priority Data

May 2, 2001 (SE) ..... 0101536

(51) Int. Cl.[7] ..... A63B 71/00
(52) U.S. Cl. ..... 482/139
(58) Field of Search ..... 482/44, 92, 105, 482/106, 108, 139; 2/159, 161.2, 161.1, 160, 170

(56) References Cited

U.S. PATENT DOCUMENTS

| | | | | |
|---|---|---|---|---|
| 3,541,990 A | | 11/1970 | Du Mas | |
| 4,400,831 A | * | 8/1983 | Rietz | 2/161.1 |
| 4,487,412 A | | 12/1984 | Meeko | |
| 5,324,244 A | | 6/1994 | Miller et al. | |
| 5,350,343 A | | 9/1994 | DaSilva | |
| 5,353,440 A | | 10/1994 | Meldeau | |
| 5,809,570 A | * | 9/1998 | Grover | 2/161.1 |
| 5,846,168 A | * | 12/1998 | Murray | 482/105 |

* cited by examiner

*Primary Examiner*—Glenn E. Richmon
(74) *Attorney, Agent, or Firm*—Jacobson Holman PLLC

(57) ABSTRACT

A conical strap-loop (1) of adjustable size which embraces part of a user's hand (7) in connection with his/her wrist. The loop includes a free-supporting elastic shaft (2) which projects forwards in the direction of the loop axis and includes a curved end-part (3) which is also free-supporting and springly elastic and which is curved through about one-half of a revolution in towards the palm of the user's hand. The width of the curved part (3) corresponds to the width of the user's palm. A handgrip (8), such as the bar of a barbell, can be positioned between the palm of the user's hand and the free end of the curved part so as to be accommodated within said curved part, which is able to straighten out elastically at low loads.

9 Claims, 1 Drawing Sheet

Fig. 1
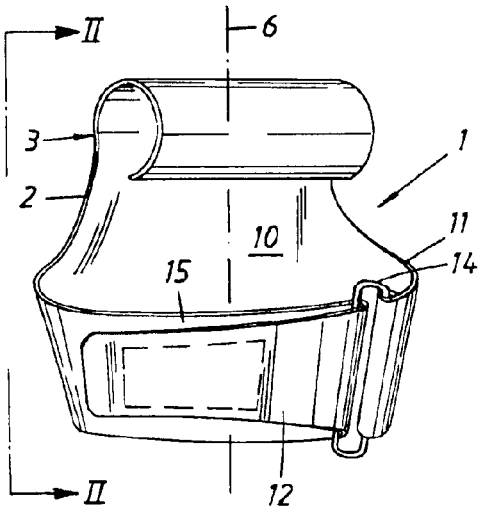
Fig. 2
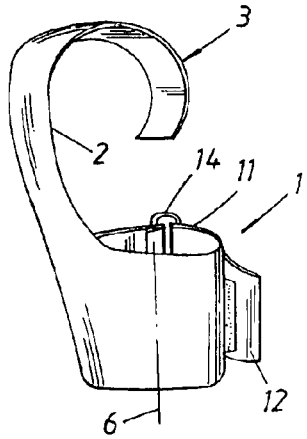
Fig. 3
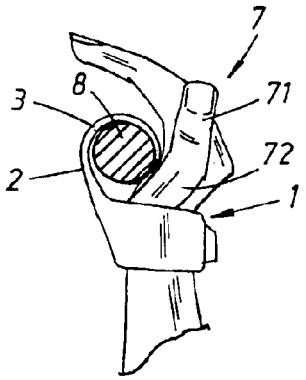
Fig. 4
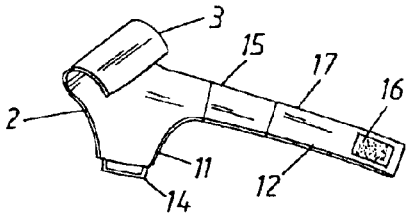
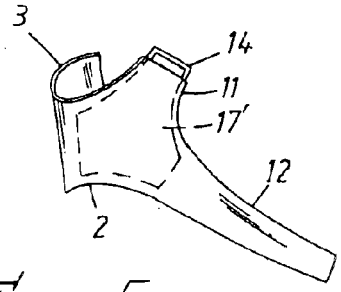
Fig. 5

GRIPPING DEVICE

This is a nationalization of PCT/SE02/00799 filed Apr. 24, 2002 and published in English.

The present invention relates to a gripping device of the kind defined in the preamble of the accompanying claim 1.

The invention thus relates to a gripping device for a handle-gripping hand, said device including a looped strap that embraces the wrist of the user and further including a so-called shank or shaft which extends in a free-supporting fashion from the strap loop in a direction generally parallel with the axial direction of said loop wherein the shaft includes at its free end a curved portion which embraces the handle or handgrip in the region of the palm of the wearer's hand.

People that perform physical exercises and also sportsmen often train with equipment that shall be gripped with one or both hands, this equipment including a handgrip. The handgrip may, for example, consist of the actual bar used in weightlifting, e.g. a barbell, or some corresponding device. The fingers and the palm of the user's hands are subjected to wear against the handgrip/bar. Moreover, it is necessary for the user to exert a relatively large force and a great deal of effort in order to maintain a hold on the handgrip. The actual training exercise, however, has no primary purpose in stabilising the forearm muscles of the user or his/her hands.

It is known to reduce the load on the forearms and the hands of a user, with the aid of a gripping device (so-called wriststrap) which includes a strap loop that embraces the wrist of the user and that also includes a flexible strap which is wound around the bar/handgrip of said equipment and held firmly to said handgrip by the fingers of the hand gripping the bar.

When the equipment/barbell is lifted, the gripping device transfers a large part of the force between the wrist and the equipment, such as to relieve the load on the hand and the forearm muscles to a corresponding degree.

Gripping devices that include a strap which is placed or wound around the grip have, however, certain drawbacks. For example, one drawback is that the strap must be wound around the handgrip/bar whilst the hand grips the handgrip generally correctly. Although effective anchoring of the strap to the handgrip is achieved when the strap is wound around the handgrip on its own accord, there is a danger that the strap will not be released from the handgrip when the user opens his/her hand.

Also known to the art are gripping devices which, in addition to a strap looped around the wrist of the user, include a hooked or curved device that comprises a rigid shaft or shank which is connected to said loop and which includes a curved portion that connects with the inside of the curved hand in which the bar is gripped. Such gripping devices are liable to injure the user, since the handgrip/bar cannot be readily released (from the hook) when handling a large mass.

Accordingly, an object of the present invention is to provide a gripping device with which the aforesaid drawbacks associated with known gripping devices of this nature are avoided, either totally or partially.

This object is achieved with a gripping device according to the independent claim 1.

Further embodiments of the invention will be apparent from the accompanying dependent claims.

One important feature of the inventive device is that the loop carries a free-supporting shaft or shank, which has a width corresponding to the width of the hand, is curved inwardly towards the user's palm, and that the curved, elastically resilient end-portion and the fingers of said hand overlap in mutually opposite directions around the handgrip/bar. The friction between the fingers and said curved portion, in their longitudinal directions, prevents the curved portion from sliding from the bar.

The loop will suitably have a conical configuration so as to embrace the conical part of the clenched hand around the back of the hand and the thumb bone. The loop is formed by a thong or strap which carries at one end an elongate deflecting ring for the other end part of said strap, this other end being threaded through the deflecting ring and fastened to itself by means, e.g., of a touch-and-close fastener when the loop has been adjusted to a desired size.

The shaft or shank connects with the loop in a position such as to be located on the inside of the hand when the ring is located on the small-finger side of the hand.

The invention will now be described by way of example with reference to the accompanying drawing.

FIG. 1 is a front view of an inventive gripping device.

FIG. 2 is a side view taken on the line 11—11 in FIG. 1.

FIG. 3 shows the gripping device when fitted to a user's hand and to a round bar.

FIGS. 4 and 5 are plan views showing the inside of the gripping device in an extended state for forming a strap loop.

The gripping device includes a strap loop 1 of adjustable size, a shaft or shank portion 2 which can be moved forwards in the direction of the axis 6 of the tubular loop 1 and the free end-portion 3 of which is bent or curved through approximately one-half of a revolution, said portion 3 extending inwardly towards the axis 6. The forwardly projecting 20, shaft-part 2 is fixedly connected to the loop 1. The portion 3, and preferably also the shaft 2, is comprised of a springy material of low bending strength. The shaft 2 and the portion 3 are free-supporting so that when in a relaxed state (not low-bearing) they will retain the illustrated shape and orientation relative to the loop 1, whereas at least the portion 3 has a small bending resistance and can thereby be straightened-out in response to a small force.

As will be seen from FIG. 1, the loop 1 is slightly conical and widens in a direction towards the end-portion 3. The illustrated gripping device consists of a sheet of springy, flexible material, for instance comprises two layers of leather that are joined together with glue and seams. The shaft 2 and the end-portion 3 curved away from said shaft may include a fabric layer between the leather layers, said portion 3 being given its memory shape by giving the three-layer material a corresponding shape prior to the glue between said three layers hardening. The central part of the pre-form or blank from which the gripping device is formed includes a slightly forwardly projecting part 11 which carries a so-called fold-over ring 14. The attachment of the ring 14 may optionally be strengthened with a reinforcement layer 17 which has a surface extension that connects with the central part 10 of said blank.

As will be seen, the elongate strap 12 extends from the main part 10. As will be seen from FIG. 4, the strap 12 includes longitudinally separate parts 15, 16 of a touch-and-close fastener. The loop 1 is formed by threading the strap 12 through the ring 14 and folding over the strap part 17 through the ring 14 and fastening said part by means of the touch-and-close fastener 15, 16 when the loop 1 has the size desired.

FIG. 3 shows the right hand 7 of a user with the strap loop 1 of the device embracing the outermost part of the user's wrist and the adjoining part of the hand, such that the loop 1 overlaps the thumb 72. Also shown is a round bar 8, e.g. a bar used with weightlifting equipment, which is gripped partially by the hand 7. The bar 8 is shown is shown to be located between the shaft. 2 and the flat of the hand, wherewith the curved part extends from the shaft or shank in towards the palm of the user's hand, whereas the fingers extend in the opposite direction so as to be able to grip around the curved part 3.

FIG. 3 shows the user's thumb 71 on the same side as the remaining fingers of the hand relative to the bar 8. It will be understood, however, that the thumb 71 may, of course, be positioned on the opposite side of the bar 8.

As the hand 7 grips the bar 2 it takes a conically widening shape from the wrist to the knuckles, and the loop 1 of the gripping device has a corresponding conical shape. The loop 1 is suitably configured so that the edge of the loop facing towards the elbow lies above the wrist joint, which is thus left free.

When the gripping device is fitted to the user's hand and the user takes a grip on the bar 8, he/she bends his/her hand 7 backwards and presses the hand against the bar 8 so as to position the bar between the insides of his/her fingers and the outside of the curved part 3. If, for some reason, the user is unable to keep hold of the bar 8 or wishes to release the bar, he/she can readily open his/her hand so that the forces acting on the bar 8 immediately bend-up the part 3 and possibly also bend-out the shaft 2 and therewith enable the bar 8 to leave the user's hand. The shaft 2 and the part 3 quickly return to their memory position shown in FIGS. 1 and 2.

As illustrated, the device has a short part 11 which connects with the ring 14, thereby positioning the ring on the little-finger side of the hand. As shown, the ring 14 includes two mutually parallel parts that connect to the part 11 and to the deflectable strap 12.

Although the illustrated gripping device is intended for the user's right hand, it will be understood that a corresponding gripping device can be configured in mirror image to the illustrated embodiment, so as to fit the left hand of the user.

Although the invention has been described with reference to the bar 8 of a barbell, it will be evident that the invention can be applied equally as well to provide a secure grip on other similar objects, such as the handgrips of sporting equipment in general.

What is claimed is:

1. A gripping device intended for a hand that grips a handgrip (8), wherein the device includes a strap-loop (1) which is intended to embrace the wrist region of the hand and which includes a gripping element (2, 3) that extends generally parallel with the direction of the loop axis and which has an end-portion (3) which is intended to lie around the handgrip (8) in a direction opposite to the direction of curvature of the fingers of said hand around the handgrip, characterised in that the gripping element is free-supporting from the loop; in that the end-part of the gripping element is pre-curved in a direction of curvature that is opposed to the direction of curvature of the user's fingers; and in that the curved end-part is springily resilient so that it can be straightened out and therewith release the handgrip at a pre-selected load.

2. A gripping device according to claim 1, characterised in that the curved part (3) is curved through about one-half of a revolution.

3. A gripping device according to claim 1, characterised in that the width of said curved part corresponds generally to the width of the palm of the user's hand.

4. A gripping device according to claim 1, characterised in that the gripping element (2, 3) includes between said end-part (3) and said loop (1) a free-supporting shaft-part (2) made of springy, elastic material so as to enable said part to bend out when positioning the handgrip between said curved part (3) and the user's hand.

5. A gripping device according to claim 1, characterised in that the loop (1) has a generally conical configuration so as to adapt to the conically widening part of the clenched hand (7) from the wrist to the finger knuckles, wherewith said loop (1) embraces the back of the hand and the thumb bone (72).

6. A gripping device according to claim 1, characterised in that said loop (1) is formed by a strap (10, 11, 12) which carries at one end (11) a ring (14) which receives the opposite end-part (12) of said strap, said end-part (12) being laid back upon itself and fastened to itself through the medium of an adjustable fastener means (15, 16) for adjusting the size of the loop (1).

7. A gripping device according to claim 6, characterised in that the fastener means is a touch-and-close fastener (15, 16).

8. A gripping device according to claim 6, characterised in that the ring (14) is fitted in a position at which it is located on the little finger side of the user's hand.

9. A gripping device according to claim 8, characterised in that the ring (14) has a generally straight boundary portion which deflects or guides the adjustment strip (12) of the strap-loop (1).

* * * * *